United States Patent [19]

Delay

[11] 4,448,650

[45] May 15, 1984

[54] PROCESS FOR THE PREPARATION OF CYCLOPENTADEC-4-YNONE AND OF ITS 3-METHYL HOMOLOGUE

[75] Inventor: Francois Delay, Carouge, Switzerland

[73] Assignee: Firmenich SA, Geneva, Switzerland

[21] Appl. No.: 498,050

[22] Filed: May 25, 1983

[30] Foreign Application Priority Data

Jul. 5, 1982 [CH] Switzerland ..... 4078/82

[51] Int. Cl.[3] ..... C25B 3/02

[52] U.S. Cl. ..... 204/59 R

[58] Field of Search ..... 204/59 R

[56] References Cited

U.S. PATENT DOCUMENTS 4,277,318 7/1981 Matlock et al. ..... 204/78

*Primary Examiner*—R. L. Andrews

*Attorney, Agent, or Firm*—Pennie & Edmonds

[57] ABSTRACT

The macrocyclic acetylenic ketones of formula

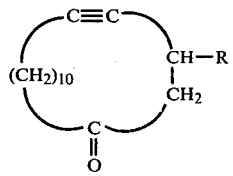

(I)

wherein symbol R designates a hydrogen atom or a methyl radical are prepared by an anodic oxidation of a hydrazone of formula

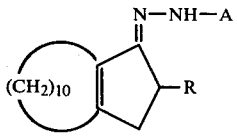

(II)

wherein R has the above given meaning and A represents a hydrogen atom or a sulfonyl radical of formula $R^1—SO_2—$, wherein $R^1$ stands for a substituted or unsubstituted aryl group.

Compounds (I) are useful industrial intermediates for the preparation of EXALTONE ® and muscone, two musk ingredients widely used in the perfume industry.

5 Claims, No Drawings

PROCESS FOR THE PREPARATION OF CYCLOPENTADEC-4-YNONE AND OF ITS 3-METHYL HOMOLOGUE

BRIEF SUMMARY OF THE INVENTION

The present invention provides a process for the preparation of a macrocyclic acetylenic ketone of formula

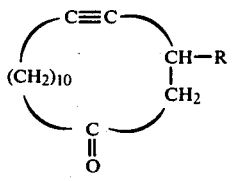

(I)

wherein symbol R designates a hydrogen atom or a methyl radical, which process consists in the anodic oxidation, in the presence of an aliphatic or an araliphatic alcohol or a glycol, of a hydrazone of formula

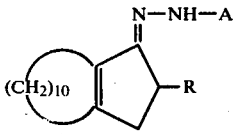

(II)

wherein symbol R has the above given meaning and A represents a hydrogen atom or a sulfonyl radical of formula $R^1—SO_2—$, wherein $R^1$ stands for a substituted or unsubstituted aryl group.

BACKGROUND OF THE INVENTION

The macrocyclic acetylenic ketones of formula (I) represent useful intermediates for the preparation of muscone and EXALTONE® (registered trademark of Firmenich S A, Geneva, Switzerland), two macrocyclic derivatives of musky odor widely used in perfumery.

European Patent Application No. 13995, open to public inspection on Aug. 6, 1980, describes a process for their preparation characterized in that (a) a hydrazone of formula

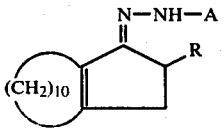

wherein R designates a hydrogen atom or a methyl radical and symbol A stands for a sulfonyl radical of formula $R^1—SO_2—$, wherein $R^1$ represents an aryl group, is treated with a halogenating reagent chosen from the following group:

bromine
chlorine
iodine
1,3-dibromo-5,5-dimethyl-hydantoin
N-bromosuccinimide
N-chlorosuccinimide, and
N-iodosuccinimide, in the presence of a lower aliphatic alcohol and at a temperature of between about −25° and +25° C.

(b) the excess of halogenating reagent is reduced, and (c) the reaction product is heated in an aqueous medium at a temperature of between 20° and 60° C.

The prior art discloses also the process illustrated by the following reaction scheme:

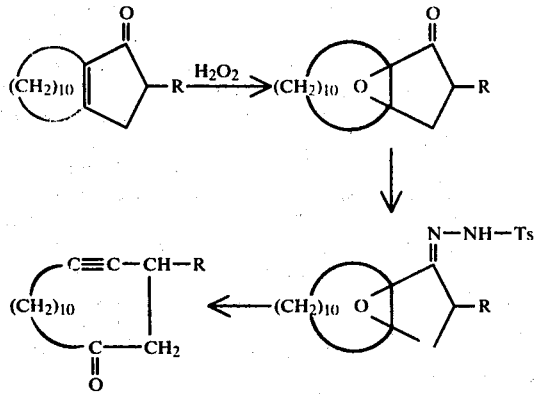

[see: Helv.Chim.Acta, 50, 708 (1967)].

THE INVENTION

The instant invention provides a novel process for the industrial preparation of compounds (I), which process is based, as stated above, on the anodic oxidation of hydrazones (II).

This process is characterized by a simple mode of operation and offers several advantages over the prior known methods.

It turned out that the course of the reaction can easily be controlled, that the operation is perfectly reproducible and that the yields observed are excellent even under different conditions of temperature, of current density or of reagents concentration. Its application to large industrial scale manufacture is thus greatly facilitated.

The anodic oxidation, which characterizes the process of the present invention, is effected in the presence of a supporting electrolyte and in a medium consisting of an alcohol and a cosolvent.

The resulting reaction product consists in a mixture essentially constituted by the desired acetylenic ketone accompanied by the corresponding bicyclic ketone of formula

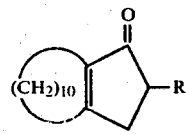

The electrolysis is carried out in a bath containing, in addition to the starting hydrazone, an aliphatic alcohol, preferably a lower aliphatic alcohol, or an araliphatic alcohol and an additional inert organic solvent chosen among the group consisting of aliphatic or aromatic nitriles and ethers.

Suitable lower aliphatic alcohols include, for instance, methanol, ethanol, propanol, butanol, 2-butanol, tert-butanol or a glycol. The presence of alcohol represents a critical factor. As araliphatic alcohol, phenylethanol is preferred.

The choice of the solvent is made as a function of the solubility of the compounds subjected to electrolysis. Good results have been obtained by conducting the anodic oxidation in the presence of a mixture consisting of an alcohol, an ether, such as tetrahydrofuran, and a nitrile, preferably acetonitrile. The proportion of these different solvents is of about 1:2:2, respectively.

Preferred supporting electrolytes include salts such as perchlorate, tetrafluoroborate, p-toluenesulfonate or hexafluorophosphate of tetra-alkylammonium. Still more preferred are tetramethylammonium tetrafluoroborate, tetraethylammonium p-toluenesulfonate and tetrabutylammonium perchlorate. Other salts, the use of which is current in organic electrochemistry, can also be utilized. The criteria for selection are determined by their stability and their solubility in the reation medium.

The concentration of the supporting electrolyte in the electrolytic solution can vary within a wide range, preferably however it is of the order of 0.1 molar.

The concentration of the starting material in the electrolytic solution is not particularly critical. Too low concentrations are not economical whereas too high ones give rise to the formation of by-products, e.g. polymers.

Preferred concentrations are of between about 1 and 5% by weight. Concerning the electrodes used in the process of the invention, they can consist in small plates of graphite or sheets of platinum for the anode and in sheets of platinum or small plates of titanium, stainless steel, MONEL ® (alloy of nickel and cupper) or nickel for the cathode. Neither, their nature nor their form must be regarded as critical in the carrying out of the process of the invention.

The current density used is of the order of 3 to 40 mA/sq.cm. The reaction temperature can be of between about 10° and 60° C., without however being limited thereto.

The invention process can be effected in the presence of air, preferably however in an inert gas atmosphere, e.g. under nitrogen or argon. Electrolysis occurs either in a single chamber or in a double chamber reactor equipped with a diaphragm. This second solution does not offer any major advantage over the first one. Moreover, one can envisage to carry out the reaction batchwise or continuously.

The invention is better illustrated by the following example wherein the temperatures are indicated in degrees centigrade and the abbreviations have the meaning common in the art.

EXAMPLE

1 G (2.5 mM) of 14-methyl-bicyclo[10.3.0]pentadec[1(12)]-en-13-one-p-toluenesulfonyl-hydrazone and 1.7 g (5 mM) of tetrabutylammonium perchlorate are dissolved in a mixture of 20 ml of tetrahydrofuran, 20 ml of acetonitrile and 10 ml of methanol. The solution is put in a cylindrical glass vessel of 100 ml equipped with a teflon type cap bearing a support for the two electrodes, a thermometer and a device for the entry and exit of argon. The two electrodes were set at 1 cm distance of one another.

The solution was magnetically stirred at room temperature during electrolysis and the current density was 7 mA/sq.cm while the voltage applied at the cells was of 2.7–3.2 V. After the passage of 4 F/mole, the current was shut down and the mixture was concentrated by stripping off. The mixture was thus treated with 30 ml of diethyl ether and the insoluble tetrabutylammonium perchlorate was recovered practically quantitatively by filtration. The filtrate was concentrated and the yellowish residue was distilled under vacuum at 13.3 Pa. There was thus obtained a mixture consisting of two isomers, viz. muscynone and methylbicyclenone of formulae

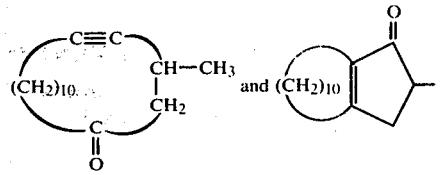

respectively, in a weight ratio of 56:44, which isomers can be separated one from another by column chromatography on silicagel (eluant:hexane/diethyl ether).

The theoretical yield of the isolated product is 80%. The reaction is effected with an anode of graphite in small plates and a cathode of platinum in small plates. Their size was 20×20×2 mm and 20×20×0.1 mm, respectively.

Analogous results were obtained by using the following electrodes combination:

| | | | | | |
|---|---|---|---|---|---|
| anode: | C[1] | C | C | C | Pt |
| cathode: | stainless steel | Ti | MONEL ® | Ni | Pt |

[1]graphite

The reaction was also carried out by replacing tetrabutylammonium perchlorate by tetraethylammonium tetrafluoroborate and hexachlorophosphate without any noticeable modification of the yields achieved.

From the trials carried out, it could be shown that the overall yield was not effected by current quantities higher than 4 F/mole. Yield however drastically decreased at lower current quantities. The reaction was also effected at a temperature of 10°, 27°, 45° and 60° without any noticeable effect on the yield obtained.

By replacing 14-methyl-bicyclo[10.3.0]pentadec-[1(12)]-en-13-one p-toluenesulfonyl-hydrazone by its lower homologue, the demethylated derivative, a 90% theoretical yield of a 56:44 mixture consisting of exaltynone and bicyclenone of formulae

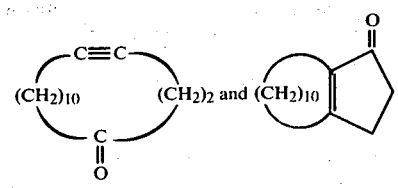

respectively, was obtained. The separation of the two products was effected by column chromatography on silicagel (eluant:hexane/diethyl ether).

What I claim is:

1. Process for the preparation of a macrocyclic acetylenic ketone of formula

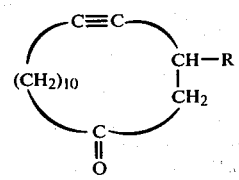

(I)

wherein symbol R designates a hydrogen atom or a methyl radical which comprises subjecting to anodic oxidation, in the presence of an aliphatic or an araliphatic alcohol or a glycol, a hydrazone of formula

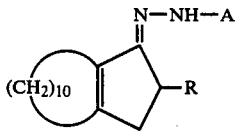

(II)

wherein symbol R has the above given meaning and A represents a hydrogen atom or a sulfonyl radical of formula $R^1$—$SO_2$—, wherein $R^1$ stands for a substituted or an unsubstituted aryl group.

2. A process according to claim 1 wherein the reaction is effected in the presence of a supporting electrolyte selected from the group consisting of tetramethylammonium tetrafluoroborate, tetraethylammonium hexachlorophosphate and tetrabutylammonium perchlorate.

3. A process according to claim 2, wherein the reaction is effected at a temperature of between 10° and 60° C.

4. A process according to claim 1, wherein the reaction is effected with a graphite or a platinum anode.

5. A process according to claim 1, wherein the reaction is carried out in an electrolytic bath containing, in addition to the starting hydrazone and the aliphatic or araliphatic alcohol, an inert organic solvent selected from the group of aliphatic or aromatic nitriles and ethers.

* * * * *